US010099814B2

(12) United States Patent
Burk

(10) Patent No.: US 10,099,814 B2
(45) Date of Patent: Oct. 16, 2018

(54) PALLET

(71) Applicant: Ryan Burk, Peosta, IA (US)

(72) Inventor: Ryan Burk, Peosta, IA (US)

( * ) Notice: Subject to any disclaimer, the term of this patent is extended or adjusted under 35 U.S.C. 154(b) by 0 days.

(21) Appl. No.: 15/445,918

(22) Filed: Feb. 28, 2017

(65) Prior Publication Data

US 2017/0174391 A1 Jun. 22, 2017

Related U.S. Application Data

(63) Continuation-in-part of application No. 14/820,951, filed on Aug. 7, 2015, and a continuation-in-part of application No. 14/249,969, filed on Apr. 10, 2014.

(60) Provisional application No. 61/865,012, filed on Aug. 12, 2013.

(51) Int. Cl.
*B65D 19/00* (2006.01)
*B65D 19/44* (2006.01)

(52) U.S. Cl.
CPC ..... *B65D 19/44* (2013.01); *B65D 19/003* (2013.01); *B65D 2519/00273* (2013.01); *B65D 2519/00796* (2013.01); *B65D 2519/00815* (2013.01)

(58) Field of Classification Search
CPC ..... B65D 19/0012; B65D 19/0026; B65D 19/0091; B65D 19/0038; B65D 19/0053; B65D 19/0095; B65D 19/44
See application file for complete search history.

(56) References Cited

U.S. PATENT DOCUMENTS

| | | | | | |
|---|---|---|---|---|---|
| 2,447,542 | A | | 8/1947 | Seqard | |
| 2,596,346 | A | | 5/1952 | Soltysik | |
| 2,626,456 | A | | 1/1953 | Harrison | |
| 3,006,049 | A | | 10/1961 | Jansson | |
| 3,433,184 | A | | 3/1969 | Addy | |
| 3,481,285 | A | * | 12/1969 | Yellin | B65D 19/0014 108/57.28 |
| 3,630,157 | A | * | 12/1971 | Ortenblad | B65D 19/0018 108/53.3 |
| 3,675,595 | A | | 7/1972 | Sullivan | |
| 3,702,100 | A | * | 11/1972 | Wharton | B65D 19/0012 108/53.3 |
| 3,720,176 | A | | 3/1973 | Munroe | |
| 3,762,342 | A | * | 10/1973 | Lawlor | B65D 19/0018 108/53.3 |
| 3,945,493 | A | | 3/1976 | Cardinal | |
| 4,022,321 | A | | 5/1977 | Barnett | |
| 4,029,023 | A | | 6/1977 | Rosewicz | |

(Continued)

*Primary Examiner* — Daniel J Rohrhoff
(74) *Attorney, Agent, or Firm* — Rathe Lindenbaum LLP

(57) ABSTRACT

A pallet includes an integral single unitary body that may include first and second outer runners continuously extending along first and second outer sides of the pallet from a third side of the pallet to a fourth opposite side of the pallet. Each of the first and second outer runners may include an elongate upwardly facing channel, a bottom wall having an upper surface forming a floor of the channel, sidewalls upwardly extending from the bottom wall and diverging from one another, side wall lips outwardly extending from the sidewalls, end walls upwardly extending from the bottom wall and diverging from one another, end wall lips outwardly extending from the end walls and end wall skirts extending downwardly from and hanging from the end wall lips. At least one deck portion is between the first and second outer runners.

19 Claims, 16 Drawing Sheets

(56) References Cited

U.S. PATENT DOCUMENTS

| | | | | |
|---|---|---|---|---|
| 4,270,657 | A | 6/1981 | Bayon | |
| 4,408,544 | A | 10/1983 | Haataja | |
| 4,741,442 | A | 5/1988 | Slocumb | |
| 4,852,330 | A | 8/1989 | Carangelo | |
| 5,086,927 | A | 2/1992 | Bach et al. | |
| 5,365,859 | A | 11/1994 | Schrage | |
| 5,458,069 | A | 10/1995 | Stolzman | |
| 5,651,463 | A | 7/1997 | Major et al. | |
| 5,794,544 | A | 8/1998 | Shuert | |
| 6,135,031 | A | 10/2000 | Heil | |
| 6,209,464 | B1 | 4/2001 | Elder | |
| 6,718,888 | B2 | 4/2004 | Muirhead | |
| 6,976,437 | B2 | 12/2005 | Fisch et al. | |
| 2003/0106470 | A1* | 6/2003 | Apps | B65D 19/0012 108/57.25 |
| 2005/0145144 | A1 | 7/2005 | Gab | |
| 2006/0075939 | A1 | 4/2006 | Shuert | |
| 2008/0019788 | A1 | 1/2008 | Clarke | |
| 2009/0288980 | A1 | 11/2009 | Hadala | |
| 2010/0175597 | A1 | 7/2010 | Persson | |
| 2012/0048154 | A1* | 3/2012 | Toomer | B65D 19/0018 108/53.3 |
| 2014/0238895 | A1 | 8/2014 | Bojie | |
| 2014/0345500 | A1* | 11/2014 | Dunn | B65D 19/0016 108/53.3 |

* cited by examiner

CROSS SECTION OF V RUNNER (2) Z-GIRTS

PALLET

CROSS-REFERENCE TO RELATED PATENT APPLICATIONS

The present application is a continuation-in-part application claiming priority under 35 USC § 120 from co-pending U.S. non-provisional patent application Ser. No. 14/249,969 filed on Apr. 10, 2014 by Ryan Burk and entitled HIGH LOAD PLASTIC PALLET, which claims priority from U.S. Provisional Application No. 61/865,012 filed in Aug. 12, 2013 by Ryan Burk, the full disclosures both of which are hereby incorporated by reference. The present application claims priority from co-pending U.S. patent application Ser. No. 14/820,951 filed in Aug. 7, 2015 by Ryan Burk and entitled PLASTIC WRAP SECUREMENT FOR PLASTIC PALLET, the full disclosure of which is hereby incorporated by reference.

BACKGROUND

The transport of objects from one place to another has been a challenge since ancient times. Storage of multiple objects also poses challenges. In addition to specialized buildings, shelves, and cupboards for storage and bucket loaders, fork lifts, trucks, carts, planes and ships for transport, pallets have been created.

Pallets can be thought of as a form of a moveable shelf or platform. Depending on the load to be moved, the construction of a pallet is critical to durability and performance. Further, it is desirable that a pallet be constructed such that a loaded pallet may be placed directly on the load of a pallet below without damaging the lower load. Some storage systems employ open racking of pallets which systems have additional requirements so that the pallets may be used in such a system.

DETAILED DESCRIPTION OF EXAMPLES

Figure 1:
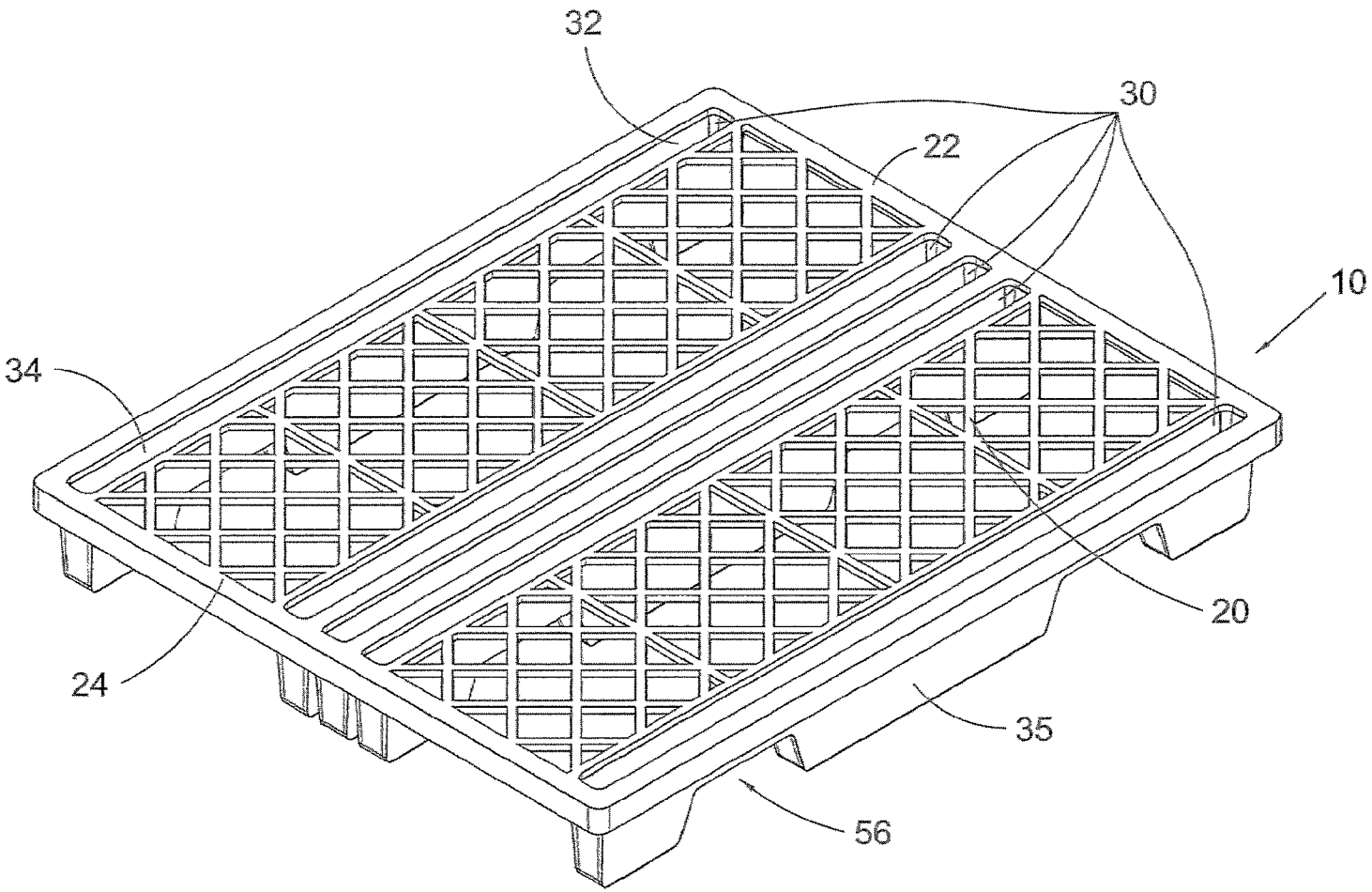
FIG. 1 depicts one embodiment of an example pallet.

While not wishing to be limited to the following characteristics, one exemplary embodiment comprises a pallet made by a molding process which may be one of several types including but not limited to structural foam molding and injection molding using thermo plastic polymers, said pallet having overall dimensions of between about 54" to about 36" length, about 54" to 36" width, and a runner depth (from deck to V/U/flattened V bottom) of between about 2.5" and about 8". The runner opening into the deck is preferably between about 1" to 4" wide but may be wider or narrower depending on the desired load capacity of the pallet and the specific runner system design. It is possible to mold the pallet of single layer construction, or to employ rotational molding and create a pallet that is double-walled construction and/or hollow at least in part. The thickness of material can be selected to provide strength as needed for the pallet's intended use.

The pallet of the present invention is typically lighter but stronger than most similarly dimensioned wood pallets. The present invention ranges between about 11 pounds and about 25 pounds depending on its intended use. For example, a pallet comprising a runner system of the present invention weighing about 17 pounds will bear the same load, and be far more durable than a wood pallet of the same dimensions weighing 45 pounds.

Finally, in many industries, such as the food industry, the present invention offers an advantage in that the pallet may be anti-microbial or, at least, impermeable to microbial materials.

Pallet 10 comprises a first edge 22 and a second edge 24, a runner system 30 and a deck portion 20. In this embodiment, the runner system 30 comprises at least one runner 35 having a first end 23, a second end 34, a top 36, a bottom 38, a depth 40, and an end profile 42. The profile 42 may be described generally as a "V" or "U" or a flattened "V" and has a first angled surface 44, a first lip 46, a second angled surface 48, a second lip 50, an apex or juncture 52 where said first angled surface 44 and said second angled surface 48 come together, and an open space 54 between said first angled surface 44 and said second angled surface 48. Each runner 35 of the runner system 30 preferably extends the length of the deck portion 20. The bottom 38 of the runner 35 may include means to facilitate ease of transport 56. Said means to facilitate transport may include an elongated notch or notches into which the tines of a forklift may be inserted. The notch or notches 56 on a first runner are aligned with the notch or notches 56 of a second runner 35 in a runner system 30 so that the tines of a forklift may be inserted through all aligned notches. The dimensions (width and depth) of means to facilitate transport may be selected when making the pallet 10 and correspond with its intended use. Said means may even take the form of openings, rather than notches, through which transportation means (including forklift and means other than forklifts) may be threaded. This same means to facilitate transportation may also serve as means for lashing several loaded pallets together, for example, by rope or cable.

The means to facilitate transportation 56 on one runner 35 may not be the same as on another runner; further, the runners 35 on a single pallet 10 may not all be of equal depth 40. These features provide multiple use and design possibilities, allowing flexibility and applicability in a multitude of uses.

The runner system 30 typically comprises more than one runner 35. Each runner 35 in the system 30 may be adjacent directly with another runner or runners 35, perhaps connected by their respective first lips 46 and second lip 50. A runner system 30 may or may not include one or more cross runners 35*a*. A runner system 30 may be any of several patterns. Many functional runner systems 30 include a runner 35 with a first end 32 located at the pallet's deck portion first edge 22 and stretching to the pallet's deck portion opposite and second edge 24 where the second end 34 is located. In other words, a runner 35 may stretch generally across the pallet's dimension of the pallet of the present invention, but this extension is not required for acceptable functionality. Cross runner 35*a* may run between two runners 35 of the runner system 30 at any one of many angles to the runners 35 of the runner system 30. A cross runner 35*a* provides additional strength and may be oriented with its open space 54 open the same direction as the runners 35 in the runner system 30 or may be oriented oppositely. The depth 40*a* of a cross runner may be less than the depth 40 of a runner 35, to allow ease of nesting. The open space 54 of the cross runner 35*a* may open into the open space 54 of a runner 35, or may not. The open space 54 of a cross runner 35*a* may or may not open into the deck portion. This structure, then, allows identical pallets to be nested when not in use; the bottom 38 of a runner 35 on a first pallet will fit into and align with the open space 54 of a runner 35 on a second pallet. It is also possible that the cross runners 35*a* may be nested with cross runners 35*a* of another pallet. Two pallets having identical runner systems 30 can, therefore, nest. A pallet having fewer runners in its system may also nest above a pallet with more runners, if the runners have correct and corresponding spacing. This nesting feature provides for storage of multiple pallets in far less space than required for conventional pallets. Where the pallets of made of plasticized material, the weight of each pallet is far less than an equal duty wood pallet. Further, the durability of the plastic pallet far outlasts that of a wooden pallet. And, lastly, the material may be selected to allow unitary structure via molding, and may offer antimicrobial features, or at least impermeability to microbial substances.

Figure 6:
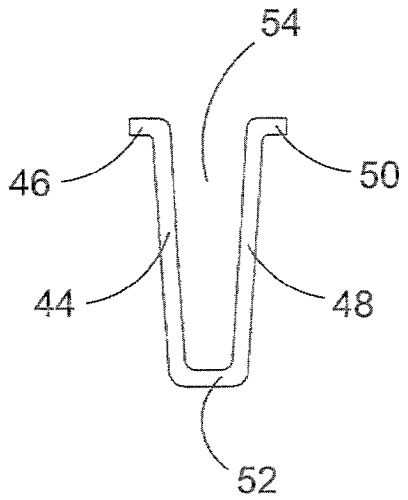
FIG. 6 is a drawing of an end view of a runner.
Figure 7:
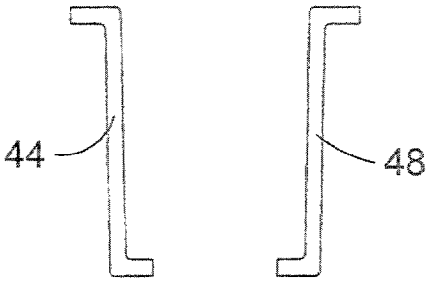
FIG. 7 is a sketch showing the two z girts placed back to back for strength.

The flattened "V" profile 42 formed at the bottom 52 of runner 35 by the meeting of the first angled surface 44 and the second angled surface 48 is key to the pallet's strength as well as its ability to nest. Referring now to FIGS. 6 and 7, specifically FIG. 7, it will be noted that a runner 35 is formed by z-girts placed back to back. The lower part of each z-girt becomes integral with the lower part of the other; the first angled surface 44 of the runner 35 comprises the first z-girt; the second angled surface 48 of the runner 35 comprises the second z-girt. This use and relative arrangement of integrated z-girts provides the superior strength of this pallet, allows the pallet to be of unitary structure, if desired, and provides its nesting capability. Alternatively, the runner 35 may be placed with the bottom 52 against the deck platform with the open space 54 opening downward. When the pallet is made of plastic material, the pallet provides superior strength, pound for pound, while also resisting infestation or contamination by biological organisms and materials.

It should be appreciated that the runner system may include a variety of groupings of runners; that the pallet does not have to be of unitary structure, and is not required to be made of plastic material. The deck portion 20 on the pallet is shown as a web, although a web is not a critical requirement for the invention. If a web is used, or a partial web, the web pattern may be one of many including openings and angles selected to provide strength and functionality as needed for the pallet's desired and intended uses. Alternatively, the deck portion 20 may be solid without openings, contoured for specific uses, or planar. Rib structures rather than or in addition to cross runners 35*a* may also be employed to add rigidity and strength. Legs or walls or partial walls may also span the open space between the angled walls 44 and 48 for added strength and rigidity. Where such leg or partial wall is located near the juncture of the walls 44 and 48, the nesting ability may be maintained.

Figure 3:
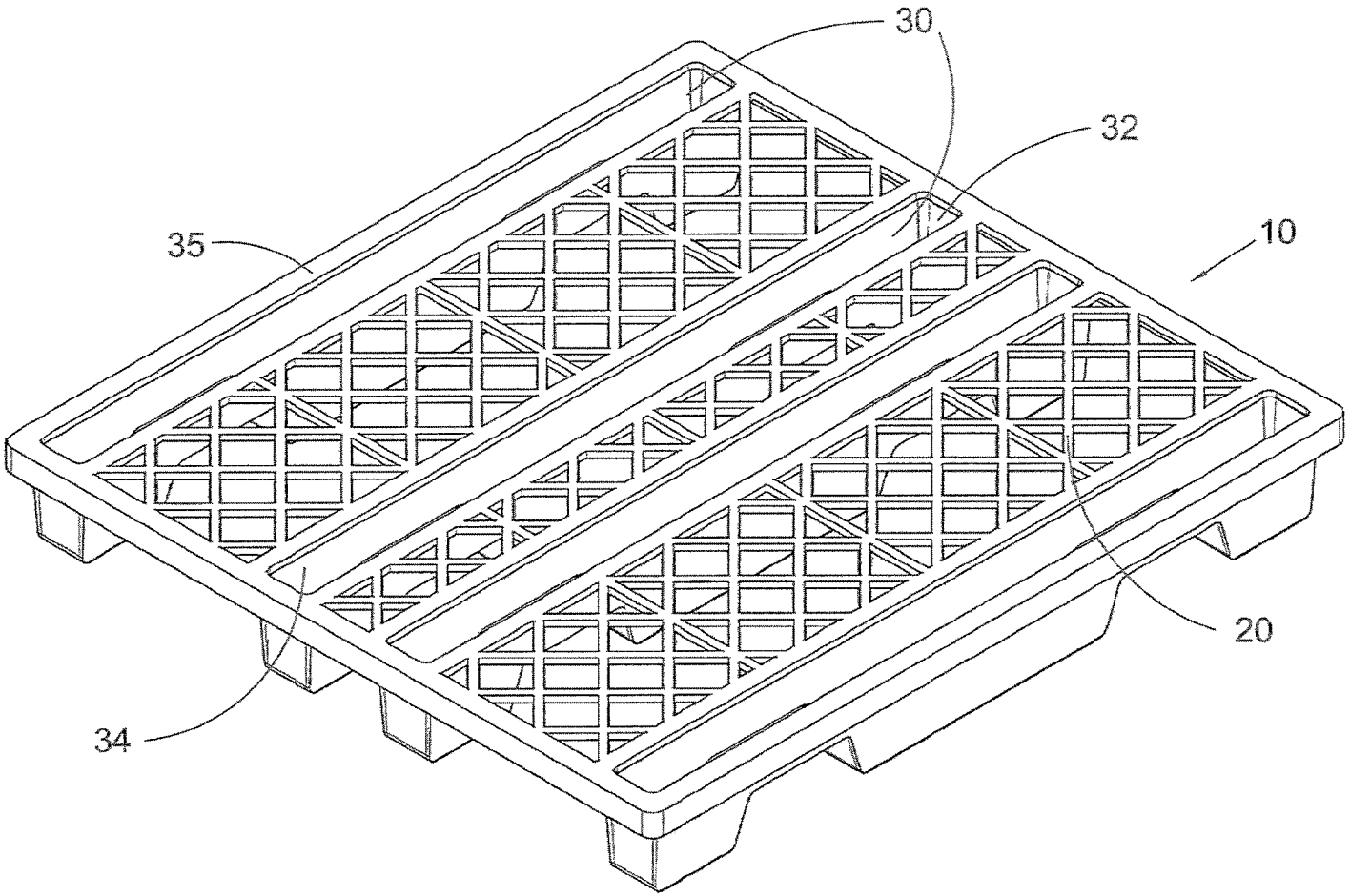
FIG. 3 depicts a third embodiment.
Figure 4:
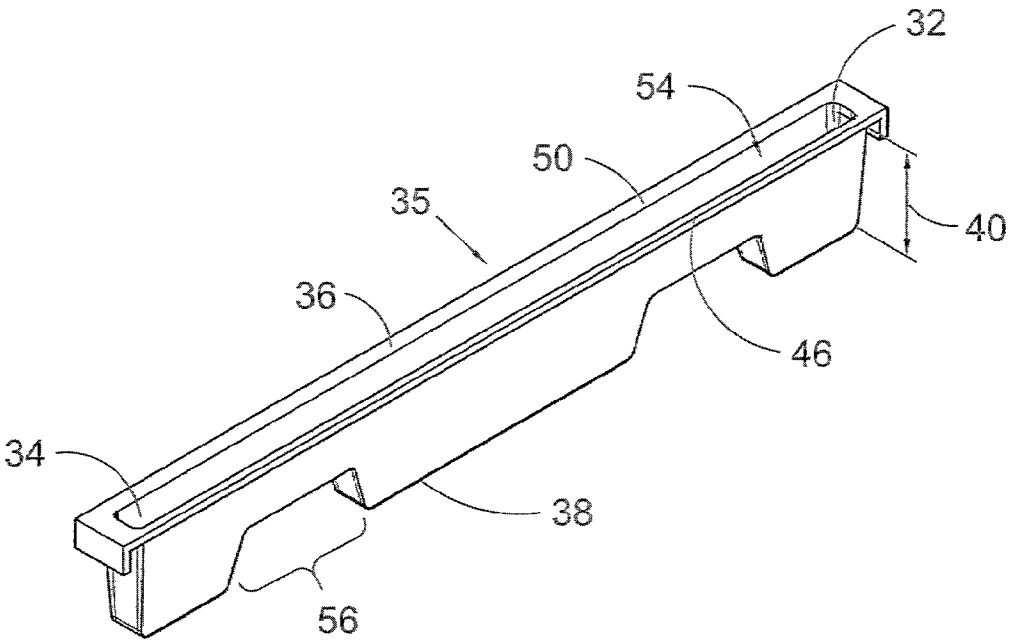
FIG. 4 is a perspective of a single runner.
Figure 5:
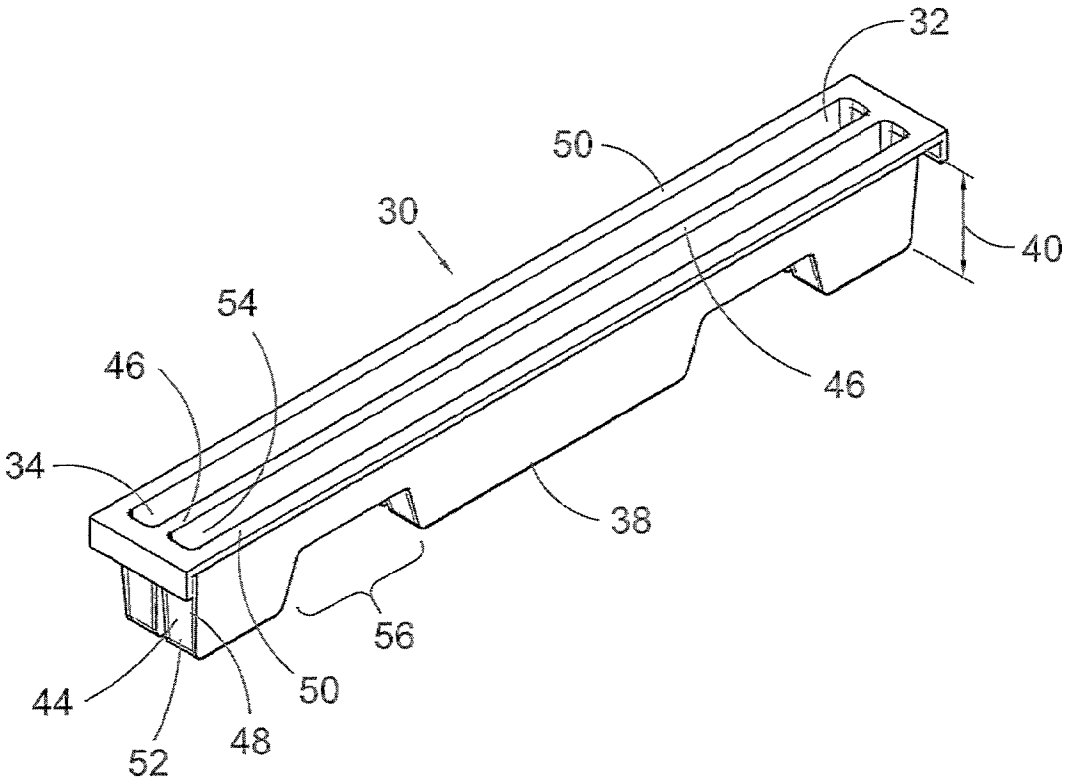
FIG. 5 is a perspective of a double runner.
Figure 12:
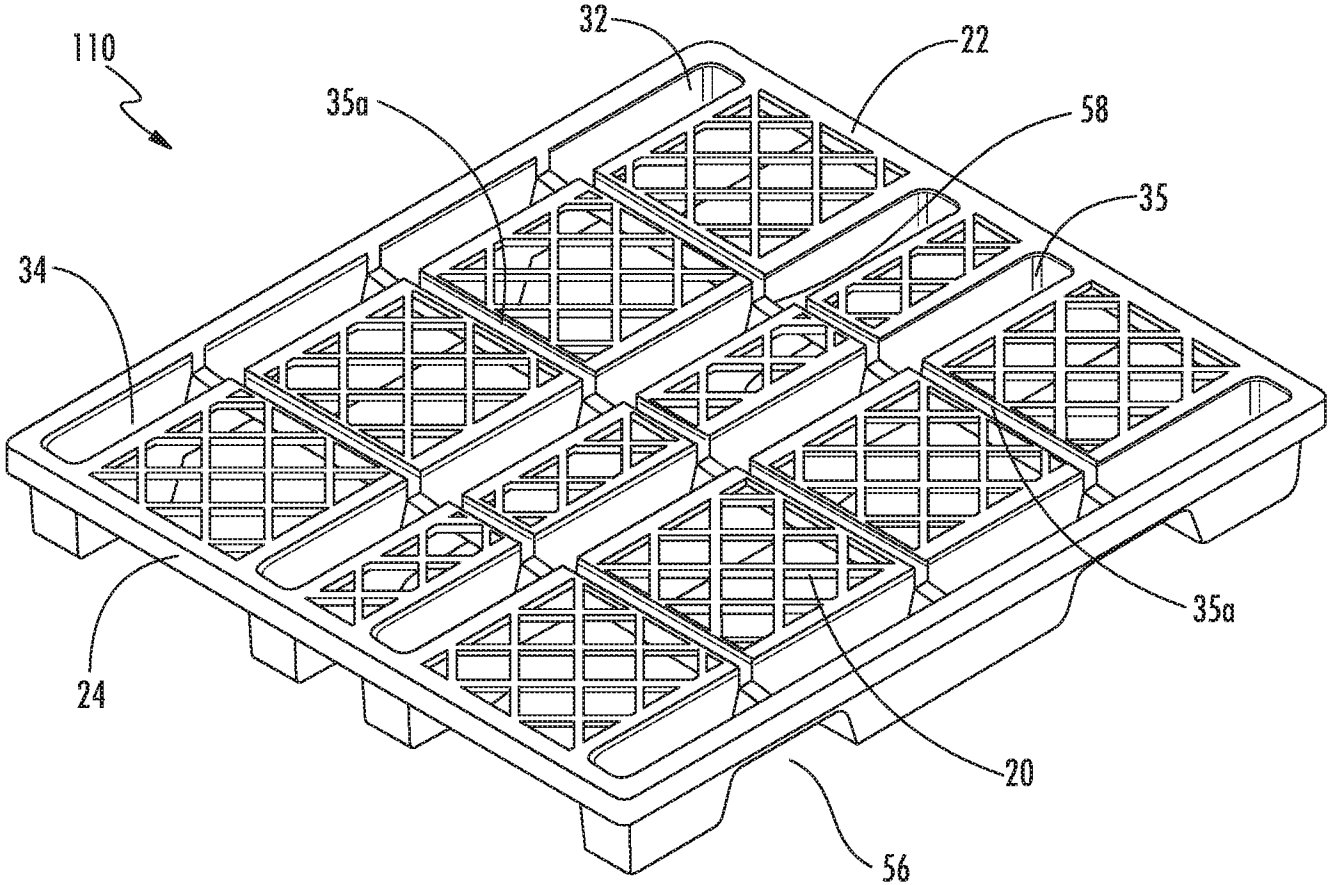
FIG. 12 is a perspective view of another example pallet.

FIG. 12 is a perspective view of another example pallet 110. 110 is similar to pallet 10 illustrated in FIG. 3 except that pallet 110 additionally comprises walls or legs 58 that span the interior of each of the channels of the various runners 35. Those remaining components of pallet 110 which correspond to pallet 10 are numbered similarly. Legs 58 are recessed relative to the upper side of pallet 110, but extend to the floor of the channel of each of such runners 35. Legs 58 provide each of such runners 35 with enhanced strength and rigidity. Because such legs 50 are recessed from the upper side of power 110, such legs 58 maintain the nesting abilities of pallet 110.

Figure 13:
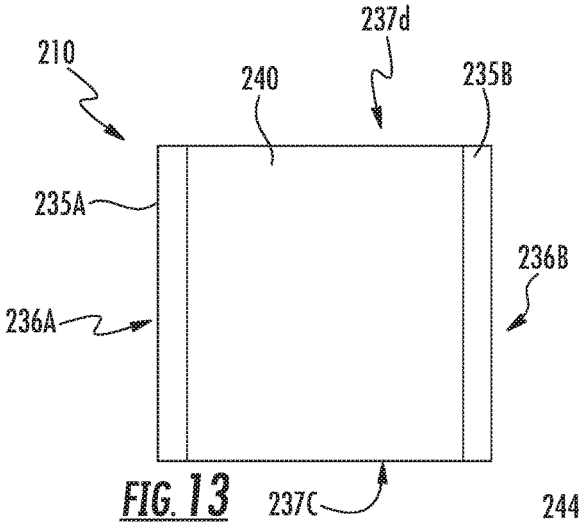
FIG. 13 is a top view schematically illustrating another example pallet.

FIGS. 13-16 illustrate an example pallet 210. FIG. 13 is a top view schematically illustrating pallet 210. As shown by FIG. 13, pallet 210 comprises an single integral unitary body, lacking separate parts that are joined by fasteners or adhesives. In one implementation, the single unitary body comprises single unitary molded structure. In one implementation, the single integral unitary body comprises a single unitary structure composed of parts that are welded or fused to one another. In one implementation, the single unitary body comprises a unitary polymer or plastic structure. In one implementation, single unitary body comprising unitary polymer plastic structure that is microbiological organism resistant and that is does not absorb water or in some cases, is hydrophobic. In one implementation, theater body form from a polymer such as high density polyethylene (HPDE). In one implementation, pallet 210 has a total weight of less than or equal to 25 pounds.

The single integral unitary body forming pallet 210 comprises first and second outermost runners 235A, 235B (collectively referred to as outermost runners 235) and decking portion 240. Outermost runners 235 continuously extend along outer sides 236A and 236, respectively, of pallet 210. Each of such outermost runners 235 continuously extend from a third side 237C to a fourth opposite side 237D.

Figure 15:
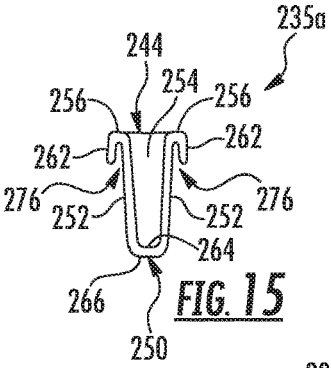
FIG. 15 is a sectional view of the runner of FIG. 14.
Figure 14:
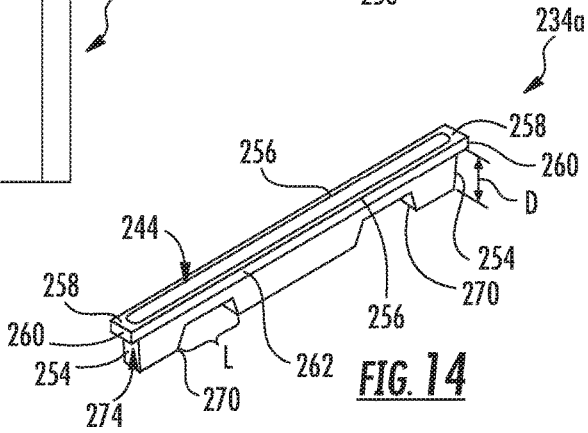
FIG. 14 is a fragmentary perspective view of a portion of the pallet of FIG. 13, illustrating an individual example runner.

FIGS. 14 and 15 illustrate an individual runner, runner 235A, in more detail. In one implementation, runners 235A and 235B identical to one another. Runner 235A comprises or provides an elongate upwardly facing channel 244 bound and surrounded by structures which comprise bottom wall 250, sidewalls 252, and walls 254 sidewall lips 256 and wall lips 258, end wall skirts 260 and sidewalls skirts 262. In one implementation, channel 244 has a depth D of at least 2 inches, providing runner 235 with enhanced load capacity or strength. Bottom wall 250 has an upper surface 264 and forms a floor of channel 244 and a lower surface 266, at least portions of which along the length of runner 235A that form the bottommost surface or plane of pallet 210 such that at least portions of the lower surface 266 serve as a foot that rests upon an underlying floor or ground surface. In one implementation, bottom wall 250 has a substantially uniform thickness along the length of runner 235A. In yet another implementation, bottom wall 250 may have a varying thickness along its length to provide enhanced strength or rigidity in selected portions of runner 235A.

As shown by FIG. 14, in the example illustrated, surface 266 extends upwardly at a plurality of spaced locations to form notches 270. In one implementation, notches 270 each have a length L of at least 3 inches and a height to receive forks of a forklift. In one implementation, notches 270 of runner 235A are in alignment with notches 270 of runner 235B such that forks of a forklift may completely pass through from side 236A through and beyond side 236B of pallet 210.

Sidewalls 252 upwardly extend from bottom wall 250. In the example illustrated, sidewalls 250 extend oblique to bottom wall 250 so as to diverge from one another. In the example illustrated, such divergence is in a smooth continuous or sloped manner. In another implementation such divergence may be in a stepped or curved manner. Such divergence facilitates nesting with other similarly configured pallets 210.

End walls 254 comprise walls that upwardly extend from bottom wall 250 at the axial ends of outermost runner 235A. In the example illustrated, end walls 254 extend oblique to bottom wall 250 and outwardly diverge from one another. In the example illustrated, end walls 254 are outwardly sloped or inclined. In other implementations, end walls 254 may outwardly diverge from one another in a stepped or curved fashion. Such divergence facilitates nesting with other simile configured pallets 210.

Sidewall lips 256 comprise panels or walls extending outwardly from sidewalls 252. In one implementation, sidewall lips 256 extend in substantially horizontal planes, forming the uppermost surfaces of pallet 210. Similarly, end wall lips 258 comprise panels or walls extending outwardly from and walls 254. In one implementation, and wall lips 258 extend in substantially horizontal planes, forming the uppermost surface of pallet 210.

End wall skirts 260 comprise panels or walls that extend outwardly from and that hang from end wall lips 258. Likewise, sidewall skirts 262 comprise panels or walls that extend outwardly from and that hang from sidewall lips 256. Skirts 260, lips 258 and upper portions of end walls 254 form downwardly facing channels 274 along the perimeter of the upwardly facing channel 244 adjacent end walls 254. Skirts 260, lips 256 and upper portions of sidewalls 252 form downwardly facing channels 276 along the perimeter of upwardly facing channel 244 adjacent sidewalls 252. Channels 274 and 276, together, form a continuous channel that continuously extends about an upper perimeter of channel 244. Channel 274 and 276 provide pallet 210 with enhanced rigidity and strength for enhanced load capacity was less structural material.

In one implementation, lips 256 have a width of at least 0.25 inches. Skirts 262 have a vertical height of at least 0.25 inches. Lips 258 have a width of at least 0.25 inches. Skirts 260 have a vertical height of at least 0.25 inches. Such dimensions allow runner 235A two provide pallet 210 with enhanced load capacities. In other implementations, such structures of each runner 235A may have other dimensions.

Decking portion 240 extends between runners 235 and provides a majority of the upper surface area of pallet 210. Decking portion 240 (schematically shown) may be perforate to allow moisture other materials to pass through while supporting larger contents. In one implementation, decking portion 240 may comprise a perforate web of angled ribs or other structures. The open nature of decking portion 240 provides material and weight savings. In other implementations, decking portion 240 may be imperforate.

Figure 16:
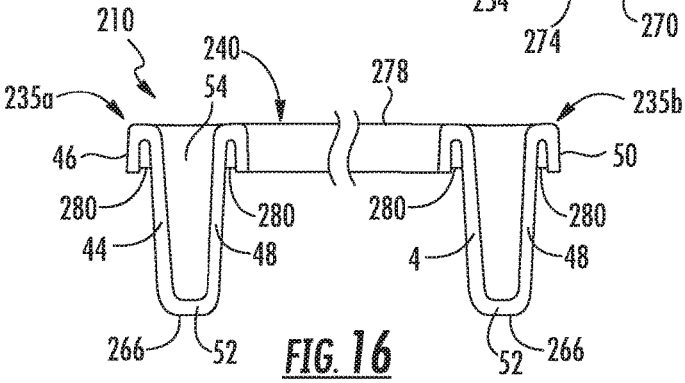
FIG. 16 is a fragmentary sectional view of the pallet of FIG. 13.

As shown by FIG. 16, in one implementation, decking portion 240 directly extends from mutually facing sidewall skirts 262 of runners 235. In one implementation, decking portion has upper edges 278 that form the uppermost face or surface of pallet 210. In one implementation, the height of decking portion 240 may be substantially equal to the height of those adjacent skirts 262.

As indicated by broken lines in FIG. 16, in some implementations, pallet 210 may additionally comprise side ribs 280 formed within channels 276. Ribs 280 extend from skirts 262 to upper portions of sidewalls 252. Ribs 280 provided spaced locations along the length of runners 235 to provide enhanced structural rigidity and strength. In one implementation, ribs 280 have a spacing of at least one rib 280 every 0.75 inches along the length of each of runners 235. In some implementations, additional and ribs may be provided within channels 274 between and wall skirts 260 and upper portions of end walls 254. In yet other implementations, such ribs 280 and the end ribs may be omitted.

Figure 17:
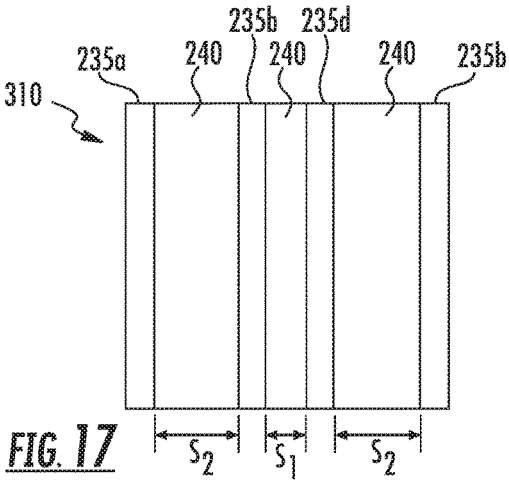
FIG. 17 is a top view schematically illustrating another example pallet.
Figure 18:
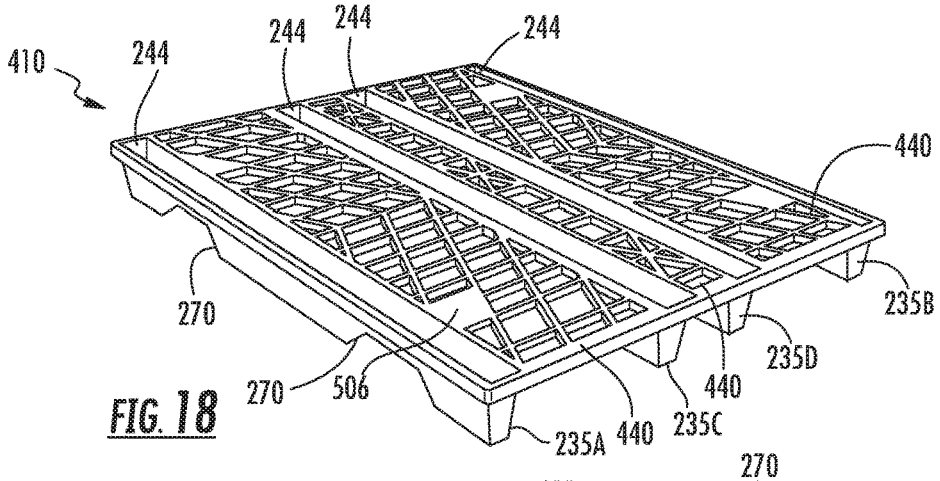
FIG. 18 is a top perspective view of another example pallet.
Figure 19:
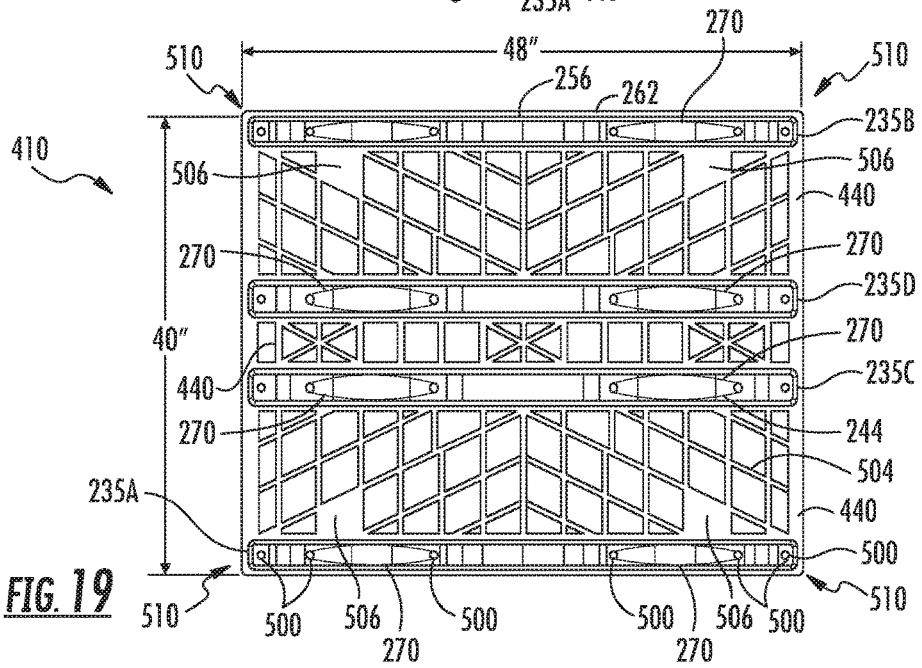
FIG. 19 is a top view of the pallet of FIG. 18.
Figure 20:
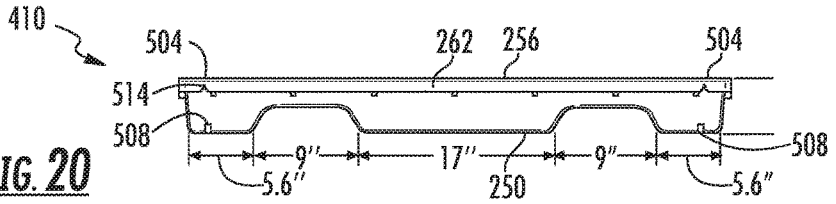
FIG. 20 is a first side view of the pallet of FIG. 19.
Figure 21:
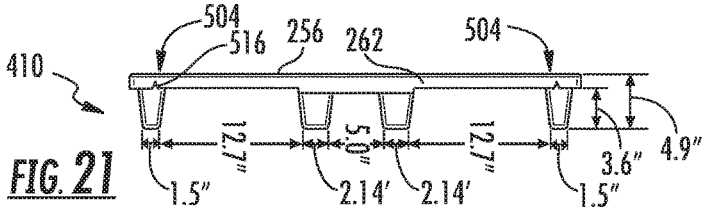
FIG. 21 a second side view of the pallet of FIG. 19.
Figure 22:
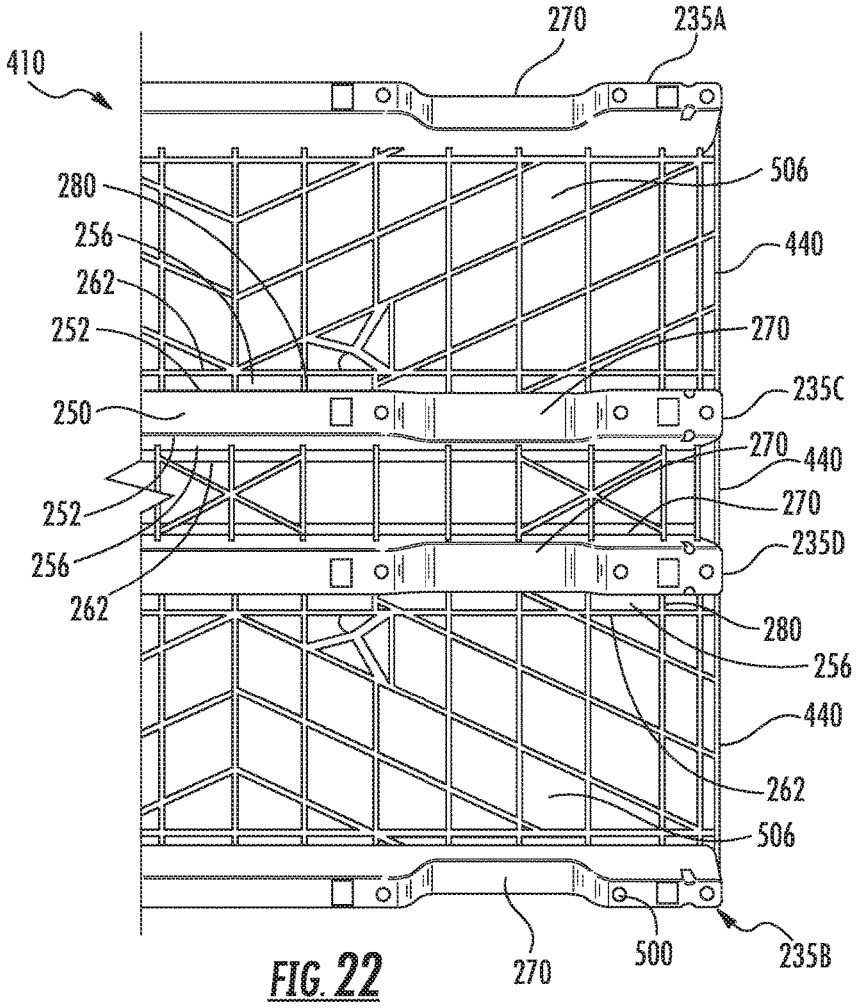
FIG. 22 is a bottom view of a portion of the pallet of FIG. 18.
Figure 23:
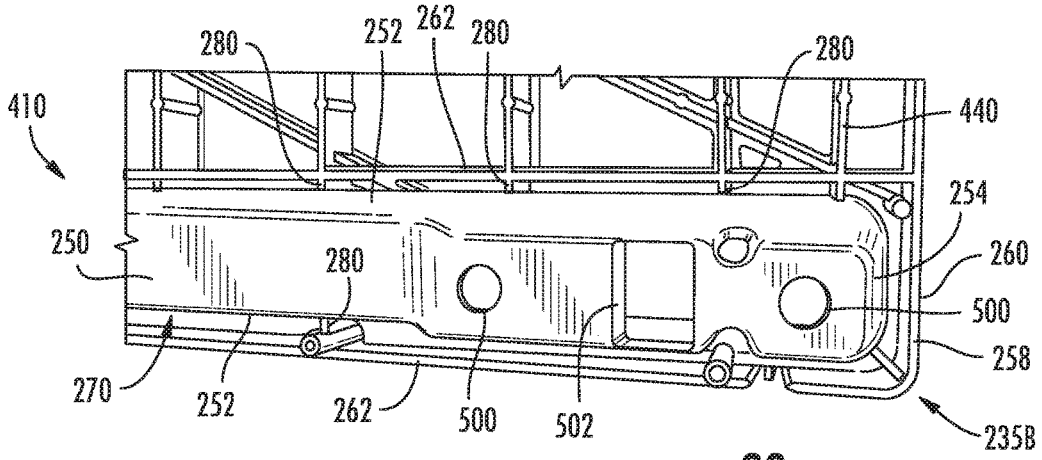
FIG. 23 is an enlarged bottom perspective view of a portion of the pallet of FIG. 18.

FIG. 17 is a top view illustrating another example pallet 310. Pallet 310 is similar to pallet 210 except that pallet 310 additionally comprises a plurality of central runners 235C and 235D (collectively referred to as central runners). Central runners 235 are located between outermost runners 235 and continuously extend from side 237C to side 237D. Each of central runners 235 is structurally similar to outermost runners 235 as described above. Central runners 235 provides enhanced central rigidity, strengthen load capacity to pallet 310.

Figure 2:
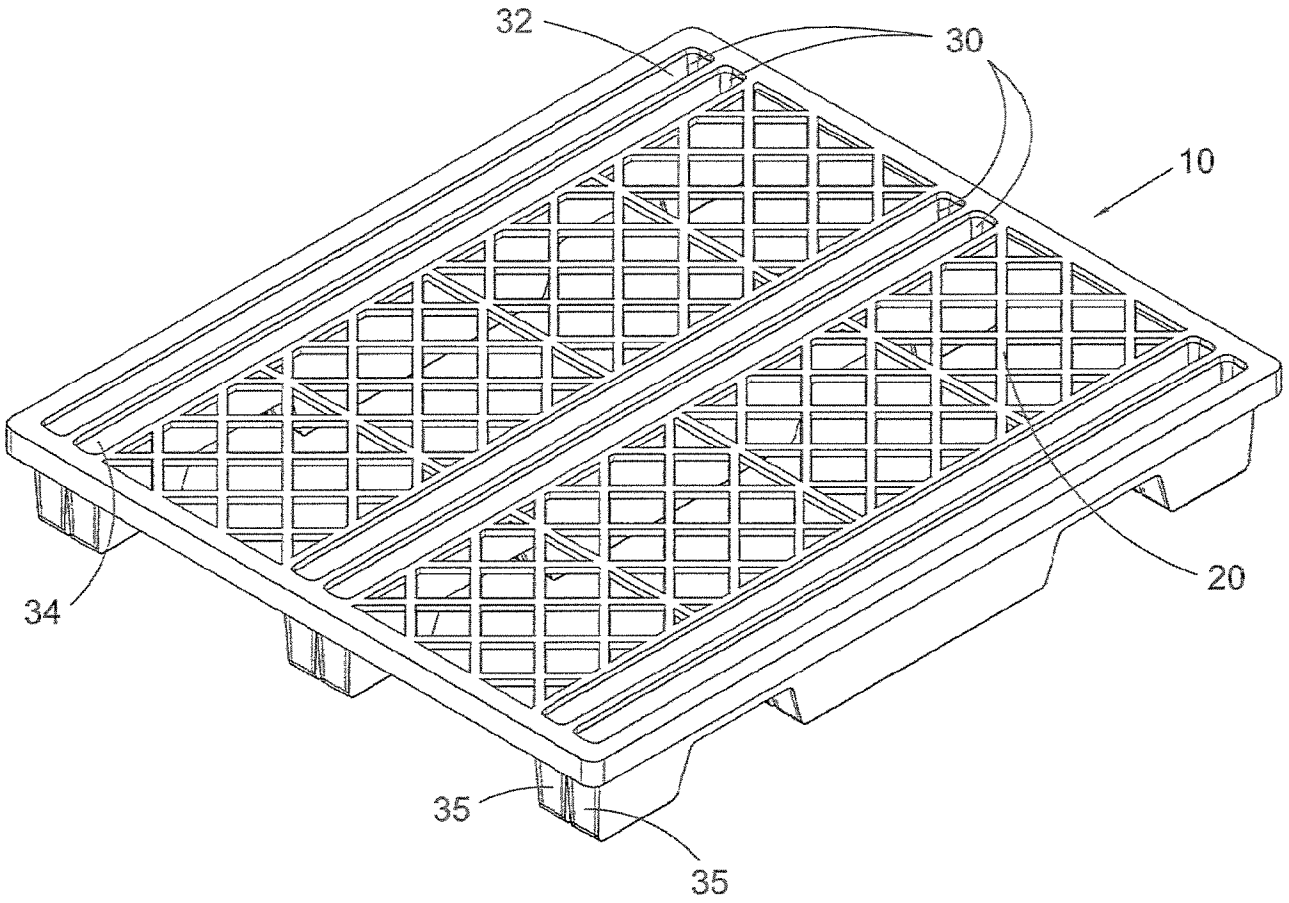
FIG. 2 shows a second embodiment of an example pallet.
Figure 8:
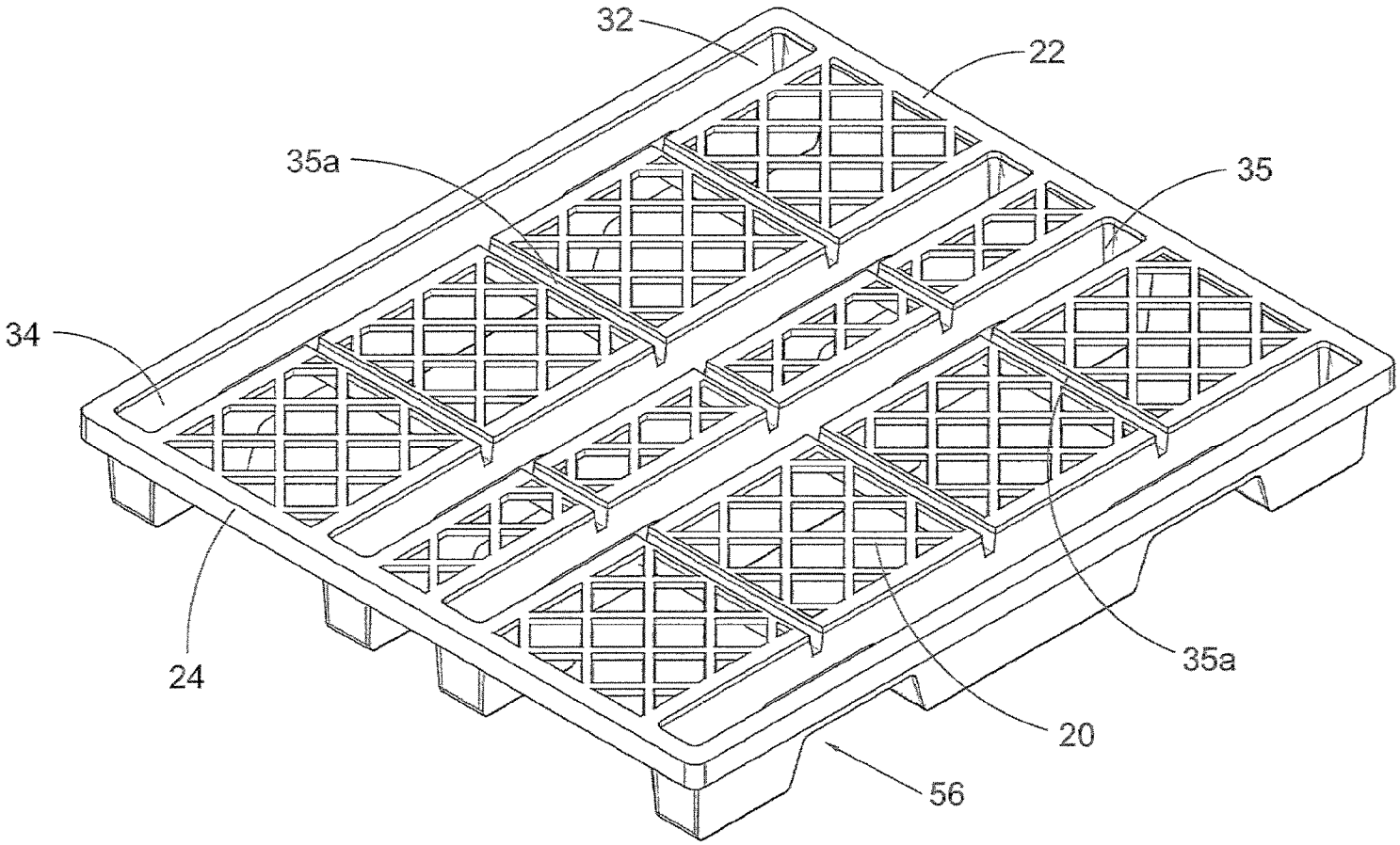
FIG. 8 depicts a fourth embodiment comprising cross runners.
Figure 9:
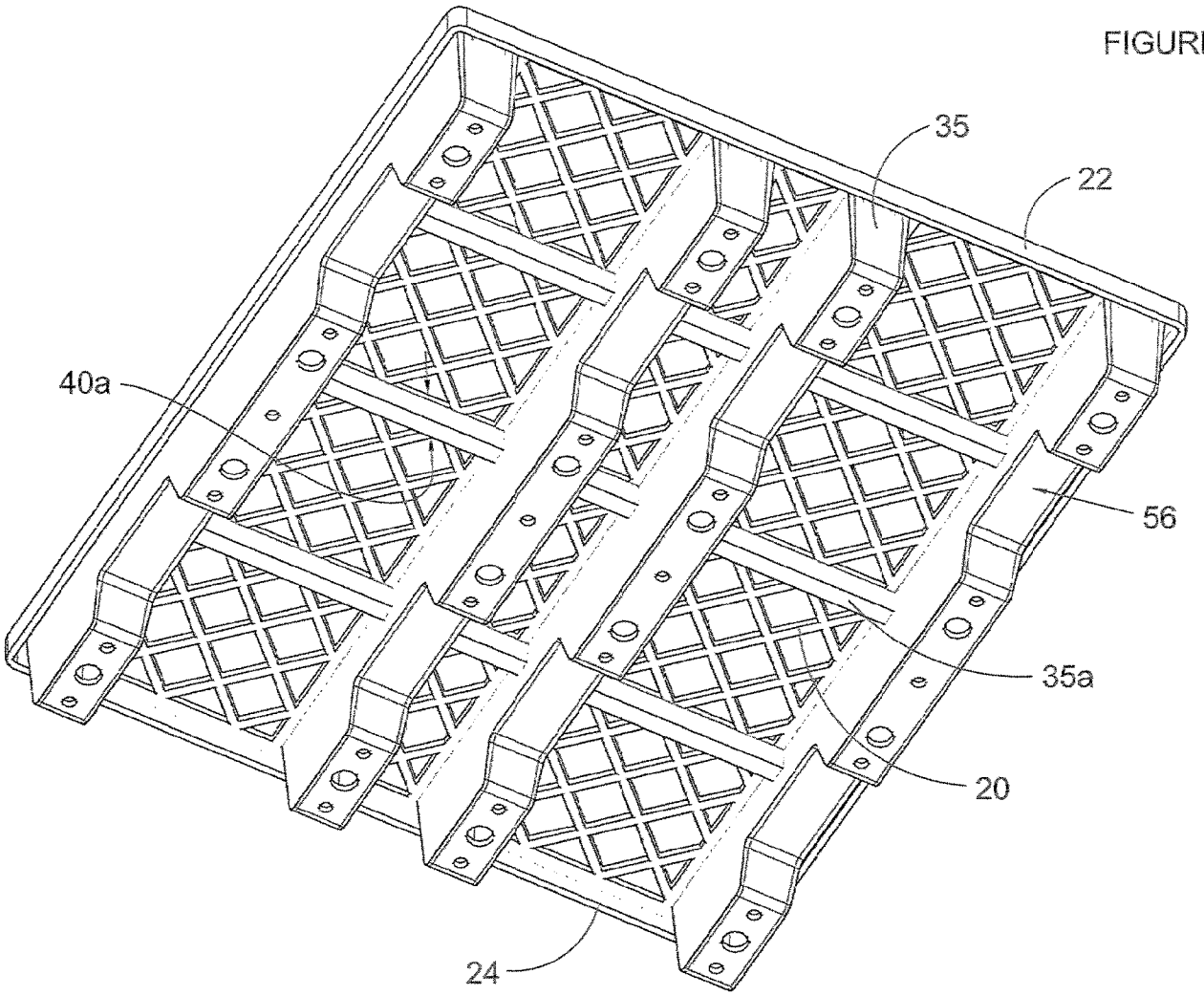
FIG. 9 shows the underside of the fourth embodiment.
Figure 10:
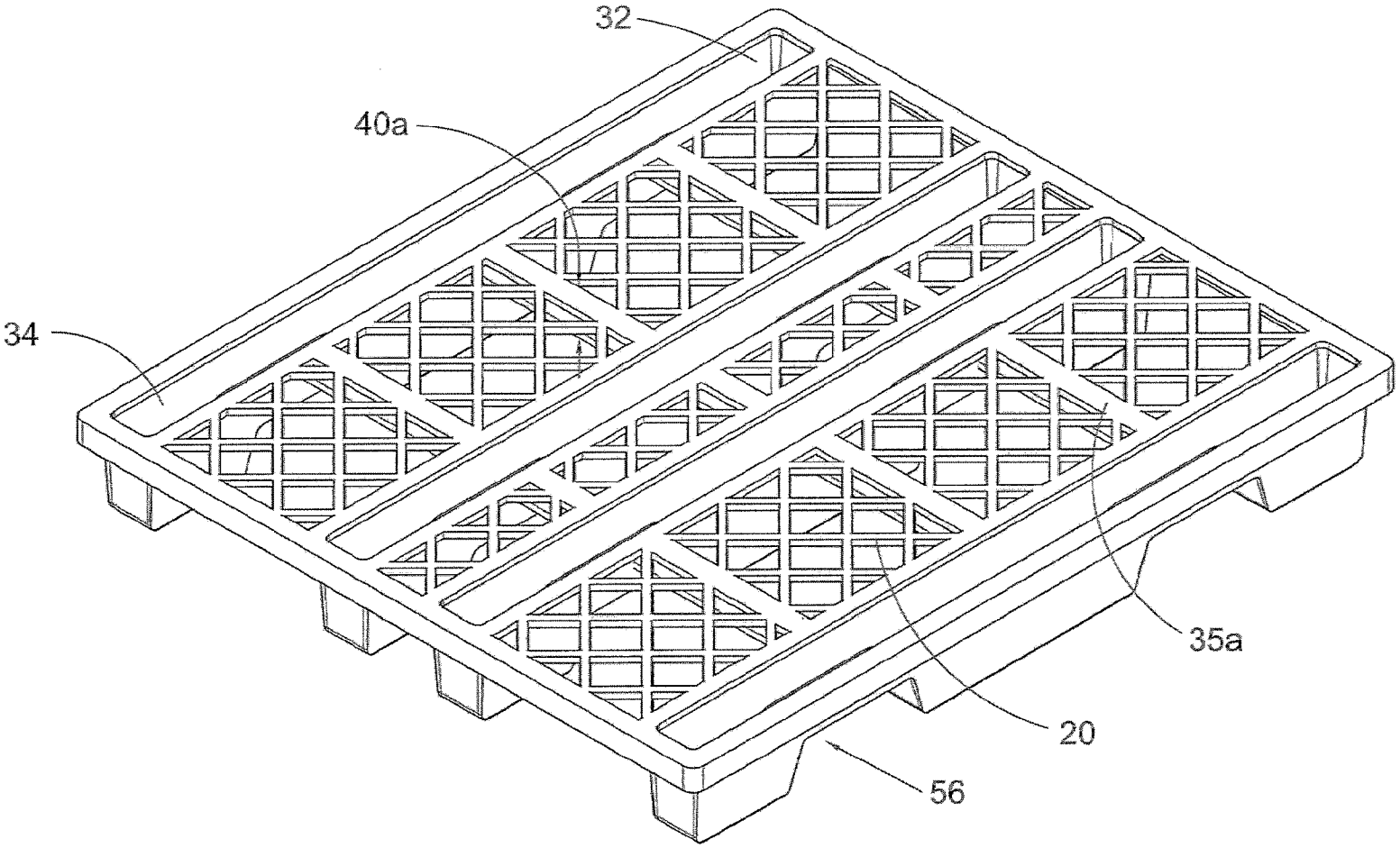
FIG. 10 depicts a fifth embodiment with cross runners inverted from those in FIG. 8.
Figure 11:
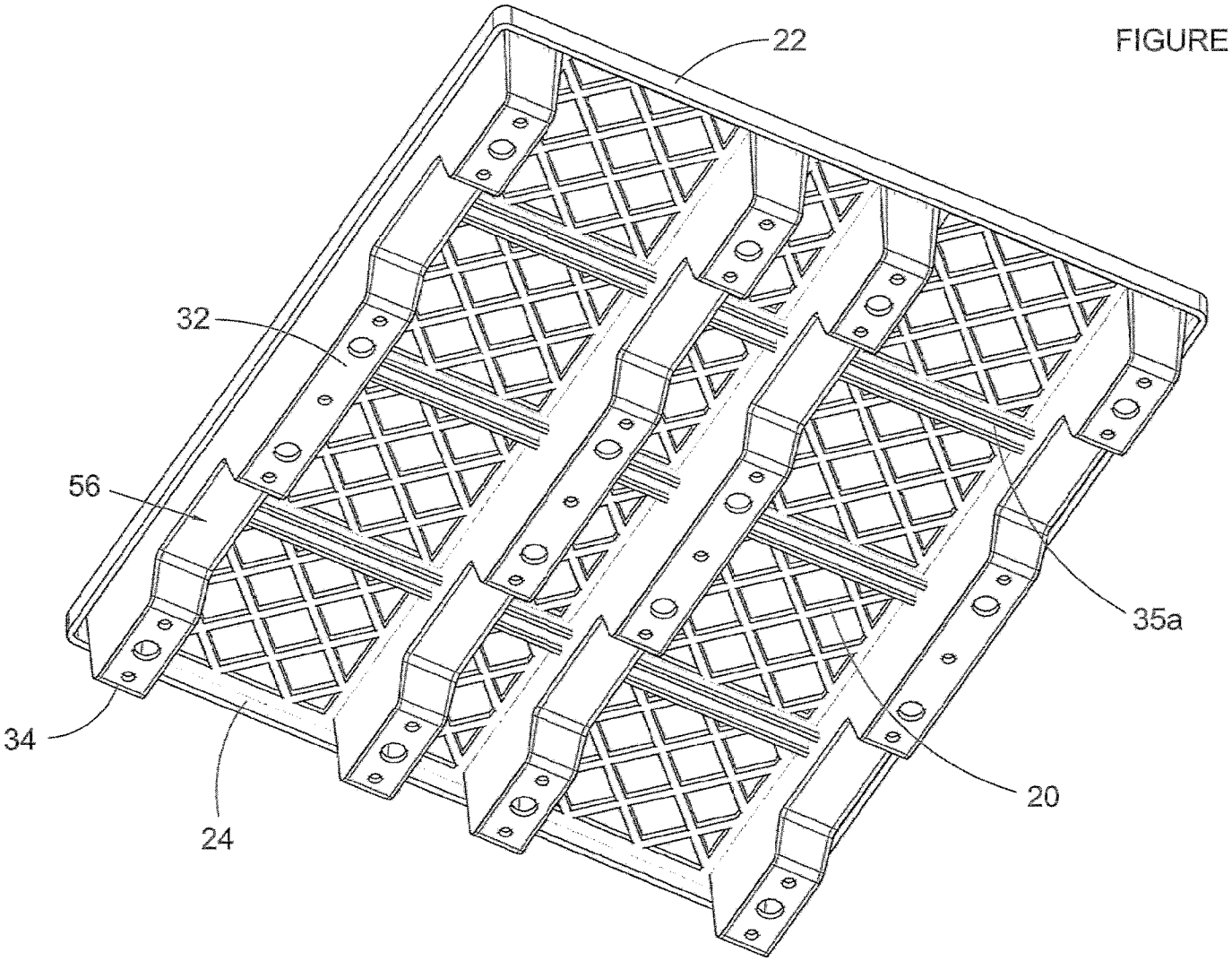
FIG. 11 shows the underside of the fifth embodiment.

In the example illustrated in FIG. 17, central runners 235 are spaced from one another by a spacing S1 and spaced from the nearest or most proximate outermost runners 235 by a spacing S2 that is greater than spacing S1. This arrangement of runners 235 provides pallet 310 with enhanced strength, rigidity and load capacity while also providing pallet 310 with a relatively low weight of less than 25 pounds. In one implementation, spacings S2 are sized and spaced from one another to receive forks of a pallet jack or forklift. In one implementation, spacings S2 are sized and spaced from one another to accommodate the forks of pallet jacks or forklifts having fork widths of 33 inches, 27 inches and 21 inches. In other implementations, pallet 310 may have other central runner arrangements or layouts. For example, pallet 310 may alternatively have central runners arranged in a layout similar to the layout shown in FIG. 1 or FIG. 2 described above, wherein each of the central runners has a configuration similar to runner 235A described above. Although each of deck portions 240 are schematically shown, it should be appreciative that each of such deck portions 240 may have configuration similar to the deck or deck portion shown in FIGS. 1-3 as described above. In some implementations, deck 210 or deck 310 in any of such designs, may additionally comprise cross runners similar to cross runners 35A shown and described above with respect to FIGS. 8 and 9. In some implementations, channels 244 of runners 235 may additionally be provided with internal legs, similar legs 58 shown and described above with respect to FIG. 12.

FIGS. 18-26 illustrate pallet 410, an example implementation of pallet 310. Pallet 410 is similar to pallet 310 except that pallet 410 is illustrated as having the specifically annotated example dimensions, as specifically comprising decking 440 and as additionally comprising drain apertures 500, runner receivers 502, corner retainers 504, pads 506, rack locating indicia 508, runner ribs 510 and outer runner gussets 512. Like pallet 310, pallet 410 have notches 270 with spacings S2 (shown in FIG. 17) that are sized and spaced from one another to accommodate the forks of pallet jacks or forklifts having fork widths of 33 inches, 27 inches, and 21 inches. Those remaining components of pallet 410 which correspond to components of pallet 310 or pallet 210 are numbered similarly.

Decking 440 comprise a perforate web formed by a plurality of interconnected and angled bars or ribs 504. The perforate nature of decking 440 not only allows moisture to pass through, but offers a height such that bagged products may pillow into such openings or perforations for retention while not extending through such openings to an extent so as to be contacted by a fork of a pallet jack or forklift. In the example illustrated, such decking is molded with the remainder of pallet 410. The molding facilitates the reduction or removal of sharp angles and edges which might otherwise rip or puncture bagged products. The omission of sharp angular edges and the provision of a relatively smooth upper surface of perforate decking 440 may facilitate use of pallet 410 without slip sheets between pallet 410 and the products being carried.

Decking 440 additionally comprises an automation friendly robotic gripping vacuum pad 506 proximate to each of the corners 510 of pallet 410. Gripping pad facilitate gripping of pallet 410 through the use of robotic suction cups or other gripping devices. In some implementations, gripping or vacuum pads 506 may be omitted.

Drain apertures 500 comprise openings or apertures extending through bottom wall 250 of each of runners 235 (outermost runners 235 and central runners 235) in those portions of bottom wall 250 that form the lowermost or bottommost planar surface of pallet 410 (those portions extending between notches 270). Drain apertures 500 facilitate the drain of water or other materials. Drain aperture 500 facilitates pressurized cleaning and washing of such pallets 410. In other implementations, pallet 410 may include additional or fewer of such drain apertures 500.

Runner receivers 502 comprise larger openings in bottom wall 250 of each of runners 235 that are configured to receive supplemental runners, elongated bars or other similar structures, that may be mounted to the underside of pallet 410. Such runners may increase the strength of pallet 410 and/or they provide additional or alternative underlying supporting surfaces for pallet 410 Runner receivers 502 of each runners 235 are in alignment with corresponding runner receivers 502 of other runners 235 of pallet 410. In some implementations, runner receivers 502 may be omitted.

Corner retainers 504 comprise structures in each of corners 510 that facilitate securement of supplemental device that assists in maintaining products, patches cargo or the like on top of pallet 410. For example, corner retainers 504 assist in securing straps, cords or the like extending across or from one corner to another corner of boxes, products or other cargo resting upon pallet 410. In another implementation, corner retainers 504 assist in securing plastic wrap or film to pallet 410 and over or about the boxes, products or other cargo resting upon pallet 410.

In the example illustrated, each of corner retainers 504 comprises a pair of spaced upwardly extending notches 514, 516 in each corner 510. Notches 514 extend into sidewalls skirts 262 proximate each of corners 510 of each of the outermost runners 235. Notches 516 extend into end wall skirts 260 510 of outermost runners 235 proximate to each of corners 510. Examples of other corner retainer configurations may be found in co-pending U.S. patent application Ser. No. 14/820,951 filed in Aug. 7, 2015 by Ryan Burk and entitled PLASTIC WRAP SECUREMENT FOR PLASTIC PALLET, the full disclosure of which is hereby incorporated by reference.

Rack locating indicia 506 facilitate the alignment or stacking of multiple simile configured pallets 410 upon one another and facilitate proper positioning of pallets 410 on a pallet rack. To satisfy certain regulations, such as certain Occupational Safety and Health Administration (OSHA) regulations, pallets supported on racks cannot overhang or project from the end of a shelf of the rack beyond acceptable extents. Rack locating indicia 506 are spaced a predetermined distance from ends 237C and 237D. Indicia 506 are spaced from one another by a distance equal to or greater than the distance separating the front edge and a rear edge of a rack shelf. In one implementation, indicia 506 are spaced from one another by a distance of at least 42 inches and nominally at least 42½ inches. As a result, with rack shelves having a depth of 42 inches, indicia are aligned with the front edge or the rear edge of such rack shelves or are within 1 inch of the front edge of the rear edge of such shelves when properly positioned on such rack shelves. Indicia 506 allow one to quickly and easily visibly inspect the proper positioning of pallets 410 on such a pallet rack. If visual inspection reveals that indicia 506 are greater than an inch or are not aligned with the front edge of a rack shelf, is a front side or the back side of the pallet 410 may be improperly overhanging from the rack shelf by too much of an extent on one side of the shelf.

In the example illustrated, indicia 506 comprise slots molded or otherwise formed in the outer sidewalls 252 of the outermost runners 235. In other implementations, indicia 506 may be formed on other surfaces along the sides 236A and/or 236B. For example, such slots or other indicia may alternatively be formed or viewable in the outer side skirt 262 of the outermost runners 235. In other implementations, indicia 506 may comprise molded protuberances or ribs at such locations or other types of indicia at such locations on pallet 410.

Figure 26:
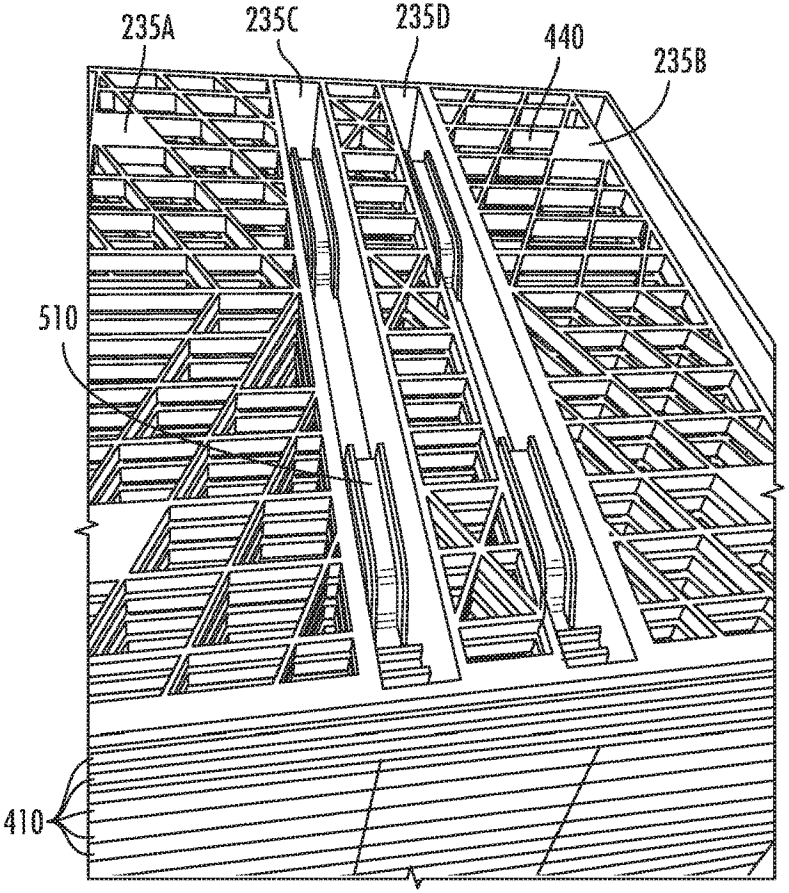
FIG. 26 is a fragmentary perspective view of a plurality of the pallets of Figure numeral 18 stacked upon one another and nested within one another.
Figure 25:
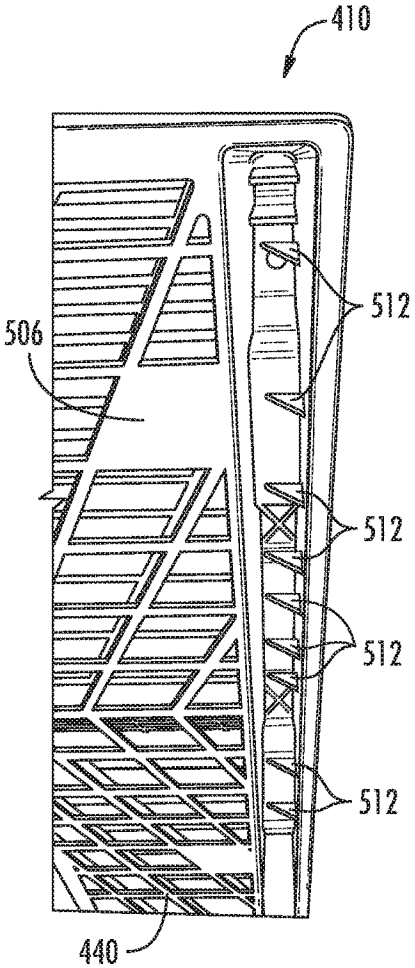
FIG. 25 is an enlarged top view of another portion of the pallet of FIG. 18.
Figure 24:
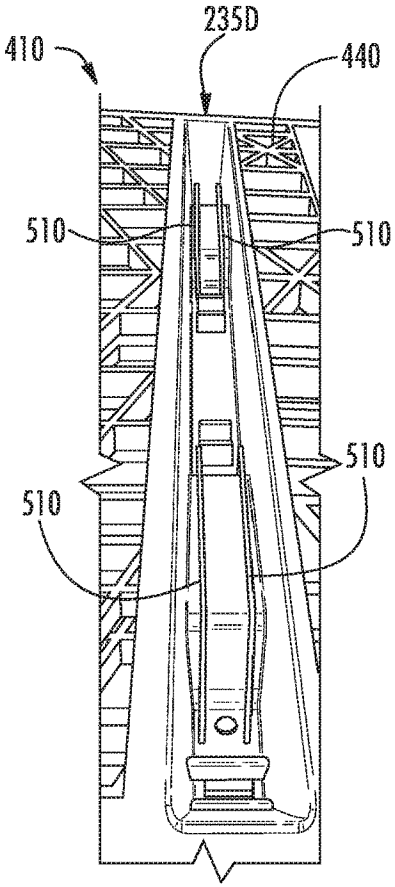
FIG. 24 is an enlarged top view of a portion of the pallet of FIG. 18.

FIGS. 24-26 illustrate an upper portion of pallet 410 in more detail. FIG. 24 illustrates the upper side of runner 235D which is similar to runner 235C. As shown by FIG. 24, runner 235C comprises ribs 520 rising up from floor 264 over the "humps" resulting from the underlying notches 270 (shown in FIGS. 22 and 23). Ribs 520 further strengthen and rigidify runner 235C in those regions that accommodate the forks of a forklift.

FIG. 25 illustrates the upper side of runner 235B which is similar to runner 235A. as shown by FIG. 25, runner 235B has an interior that further comprises gussets 524 between floor 264 and the outermost side of runner 235B. Each gusset 524 fills the corner between floor 264 and the interior surface of the outer side wall of runner 235B. gussets 524 provide the outer side of the outer runners 235A and 235B with additional strength and rigidity which resists outward bending of the outer side of outer runners 235A and 235B. Such enhanced rigidity enhances the ability of pallet 410 to carry non-sustaining loads or super stacks, such as loads of particulate materials.

FIG. 26 is a top view of a plurality of pallets 410 stacked upon one another and nested within one another. As shown by FIG. 26, pallets 410 tightly stack and nest with respect to one another so as to occupy less volume during shipment, storage or when not being used. As shown by FIG. 26, pallets 410 nested within one another such that the lower edges of skirts 260 rest upon surface 258 of an underlying pallet 410 and such that the lower edges of skirts 262 rest upon the upper surface to 56 of an underlying pallet 410 At the same time, as discussed above, pallets 410 are more easily fabricated and molded from a single unitary body out of a polymer material and are lightweight.

In the example illustrated, as indicated by dimensional markings, sides 236A and 236B of pallet 410, adjacent outermost runners 235, have a length of approximate 48 inches whereas sides 237C and sides 237D have a length of approximately 40 inches. In other implementations, such structures may have other dimensions. Pallet 410 is formed from a molded microbiological organism resistant polymer plastic such as polypropylene and has a material thickness of between $1/16^{th}$ of an inch and ¼ of an inch, and nominally ⅛ of an inch. Due to its specific configuration, dimensions and materials, pallet 410 has a weight of between 16 pounds and 24 pounds and less than or equal to 17 pounds. Pallet 410 does not absorb water and is hydrophobic or water repellent. Pallet 410 may be hundred percent recyclable and facilitates the drainage of water so as to be washed on ready. Pallet 410 may be open rackable and 42 inch deep pallet racks, as a dynamic load capacity of at least 2500 pounds, as I did I make it static load capacity of at least 4500 pounds, is roller conveyor double up to 5.25 inches on center, is automation friendly (through vacuum pads 506), is nestable with other similar pallets, such as up to 60 pallets per stack, may be arranged in up to 30 stacks per truck with 1800 pallets being containable within a 53 foot semi truck vehicle. Pallet 410 may also be eligible for import/export applications, being ISPM-15 exempt. In other implementations, pallet 410 may be formed from other materials and may have other dimensions.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A pallet comprising:

an integral single unitary body comprising:

first and second outer runners continuously extending along first and second outer sides of the pallet from a third side of the pallet to a fourth opposite side of the pallet, each of the first and second outer runners comprising:

an elongate upwardly facing channel having an empty volume extending from an upper face of the pallet and continuously extending, without interruption, from the third side of the pallet to the fourth opposite side of the pallet, the elongate upwardly facing channel having a centerline that is perpendicular to the third side of the pallet and to the fourth opposite side of the pallet along the entire length;

a bottom wall having an upper surface forming a floor of the channel, at least portions of the bottom wall forming a bottommost plane of the pallet;

sidewalls upwardly extending from the bottom wall and diverging from one another, the sidewalls being flat and comprising a first side wall and a second sidewall;

side wall lips outwardly extending from the sidewalls, the side wall lips comprising a first side wall lip outwardly extending from the first side wall and a second side wall lip outwardly extending from the second sidewall;

end walls upwardly extending from the bottom wall and diverging from one another, the end walls comprising a first end wall proximate the first side of the pallet and a second end wall proximate the second side of the pallet;

end wall lips outwardly extending from the end walls, the end wall lips comprising a first end wall lip extending in a first direction from the first end wall and a second end wall lip extending in a second direction, opposite the first direction, from the second end wall;

a first side wall skirt extending downwardly from and hanging from the first side wall lip;

a second side wall skirt extending downwardly from and hanging from the second sidewall lip; and end wall skirts extending downwardly from and hanging from the end wall lips, the end wall skirts comprising a first end wall skirt extending downwardly from and hanging from the first end wall lip and a second end wall skirt extending downwardly from and hanging from the second end wall lip; and at least one deck portion between the first and second outer runners, the at least one deck portion having a lower most surface and an uppermost surface, wherein an entire upper surface of each of the sidewall lips, extending from the first end wall to the second end wall, is coplanar with the uppermost surface of the at least one deck portion, wherein the bottom wall of each of the first and second outer runners continuously extends from the first end wall to the second end wall, wherein an entirety of the bottom wall from the first end wall to the second end wall is below the lower most surface of the at least one deck and wherein the pallet has a top profile corresponding to a bottom profile of the pallet such that the pallet is nestable with respect to another identical pallet with the lower most surface of the least one deck portion resting directly upon and contacting the uppermost surface of the other identical pallet.

2. The pallet of claim 1, wherein the sidewall skirts and the end wall skirts, together, continuously extend about the upwardly facing channel to form a downwardly facing channel that extends along and about an exterior of the upwardly facing channel, the downwardly facing channel continuously extending along an entire length of the upwardly facing channel.

3. The pallet of claim 2 further comprising a plurality of spaced ribs extending within and across the downwardly facing channel so as to extend between and interconnect the sidewall skirts and the sidewalls.

4. The pallet of claim 1, wherein the first and second outer runners comprise:

a first outer runner having a first pair of spaced notches on an underside of the pallet;

a second outer runner having a second pair of spaced notches on the underside of the pallet.

5. The pallet of claim 4 further comprising a third runner between the first and second outer runners, the third runner having a third pair of spaced notches, wherein the first pair of spaced notches, the second pair of spaced notches and the third pair of spaced notches are each in alignment with one another.

6. The pallet of claim 5, wherein the at least one deck portion comprises a web formed by a plurality of interconnected ribs, the web extending between, interconnected to and supported by the first outer runner and the third runner.

7. The pallet of claim 5, wherein the third runner comprises an elongate upwardly facing channel and further comprising:

a bottom wall having an upper surface forming a floor of the channel, at least portions of the bottom wall forming a bottommost plane of the pallet;

sidewalls upwardly extending from the bottom wall and diverging from one another;

side wall lips outwardly extending from the sidewalls;

end walls upwardly extending from the bottom wall and diverging from one another;

end wall lips outwardly extending from the end walls; and end wall skirts extending downwardly from and hanging from the end wall lips.

8. The pallet of claim 7, wherein the third runner further comprises a side wall skirt extending downwardly from and hanging from at least one of the side wall lips of the third runner, wherein the web extends between and is interconnected to the side wall skirt of the third runner and the sidewalls skirt of the first runner.

9. The pallet of claim 1 further comprising:

a plurality of central runners between the first and second outer runners, each of the central runners comprising:

a bottom wall having an upper surface forming a floor of the channel, at least portions of the bottom wall forming a bottommost plane of the pallet;

sidewalls upwardly extending from the bottom wall and diverging from one another;

side wall lips outwardly extending from the sidewalls;

end walls upwardly extending from the bottom wall and diverging from one another;

end wall lips outwardly extending from the end walls; and end wall skirts extending downwardly from and hanging from the end wall lips.

10. The pallet of claim 9, wherein the plurality of central runners are spaced by a first distance and wherein one of the first and second outer runners is spaced from a closest one of the plurality of central runners by a second distance greater than the first distance.

11. The pallet of claim 1, wherein the first and second outer runners comprise a first runner forming first and second corners of the pallet and a second runner forming third and fourth corners of the pallet and wherein the pallet further comprises:

a first notch in the outer sidewall skirt of the first runner proximate the first corner;

a second notch in one of the end wall skirts of the first runner proximate the first corner;

a third notch in the outer sidewall skirt of the first runner proximate the second corner;

a fourth notch in one of the end wall skirts of the first runner proximate the second corner;

a fifth notch in the outer sidewall skirt of the second runner proximate the third corner;

a sixth notch in one of the end wall skirts of the second runner proximate the third corner;

a seventh notch in the outer sidewall skirt of the second runner proximate the fourth corner; and an eighth notch in one of the end wall skirts of the second runner proximate the fourth.

12. The pallet of claim 1, wherein the integral single unitary body comprises a unitary plastic structure having a weight of less than or equal to 24 pounds.

13. The pallet of claim 1, wherein the least one deck portion comprises an open web of intersecting ribs.

14. A pallet comprising:

an integral single unitary body comprising:

first and second outer runners continuously extending along first and second outer sides of the pallet from a third side of the pallet to a fourth opposite side of the pallet;

a plurality of central runners between the first and second outer runners, each of the first and second outer runners and the plurality of central runners comprising:

an elongate and upwardly facing channel having an empty volume extending from an upper face of the pallet and continuously extending, without interruption, from the third and side of the pallet to the fourth opposite side of the pallet, the elongate upwardly facing channel having a centerline that is perpendicular to the third side of the pallet and to the fourth opposite side of the pallet along the entire length;

a bottom wall having an upper surface forming a floor of the channel, at least portions of the bottom wall forming a bottommost plane of the pallet;

sidewalls upwardly extending from the bottom wall and diverging from one another, the sidewalls flat and comprising a first side wall and a second sidewall;

side wall lips outwardly extending from the sidewalls, the side wall lips comprising a first side wall lip outwardly extending from the first side wall and a second side wall lip outwardly extending from the second sidewall;

end walls upwardly extending from the bottom wall and diverging from one another, the end walls comprising a first end wall proximate the first side of the pallet and a second end wall proximate the second side of the pallet;

end wall lips outwardly extending from the end walls, the end wall lips comprising a first end wall lip extending in a first direction from the first end wall and a second end wall lip extending in a second direction, opposite the first direction, from the second end wall;

a first side wall skirt extending downwardly from and hanging from the first side wall lip;

a second side wall skirt extending downwardly from and hanging from the second sidewall lip; and end wall skirts extending downwardly from and hanging from the end wall lips, the end wall skirts comprising a first end wall skirt extending downwardly from and hanging from the first end wall lip and a second end wall skirt extending downwardly from and hanging from the second end wall lip wherein the sidewall skirts and the end wall skirts, together, continuously extend about the upwardly facing channel to form a downwardly facing channel that extends along and about an exterior of the upwardly facing channel; and a plurality of spaced ribs extending within and across the downwardly facing channel so as to extend between and interconnect the sidewall skirts and the sidewalls; and at least one deck portion between the first and second outer runners, the at least one deck portion having a lower most surface and an uppermost surface, wherein an entire upper surface of each of the sidewall lips, extending from the first end wall to the second end wall, is coplanar with the uppermost surface of the at least one deck portion, wherein the bottom wall of each of the first and second outer runners continuously extends from the first end wall to the second end wall, wherein an entirety of the bottom wall from the first end wall to the second end wall is below the lower most surface of the at least one deck and wherein the pallet has a top profile corresponding to a bottom profile of the pallet such that the pallet is nestable with respect to another identical pallet with the lower most surface of the least one deck portion resting directly upon and contacting the uppermost surface of the other identical pallet.

15. The pallet of claim 14, wherein the plurality of central runners are spaced by a first distance and wherein one of the first and second outer runners is spaced from a closest one of the plurality of central runners by a second distance greater than the first distance.

16. The pallet of claim 14, wherein the integral single unitary body comprises a unitary plastic structure having a weight of less than or equal to 20 pounds.

17. The pallet of claim 14, wherein the at least one deck portion comprises a web formed by a plurality of interconnected ribs, the web extending between, interconnected to and supported by the one of the first and second outer runners and one of the central runners.

18. The pallet of claim 14, wherein the first and second outer runners and the plurality of central runners each comprise an aperture through a floor of the channel.

19. The pallet of claim 14, wherein the least one deck portion comprises an open web of intersecting ribs.

* * * * *